US009993669B2

(12) United States Patent
Casebolt et al.

(10) Patent No.: US 9,993,669 B2
(45) Date of Patent: Jun. 12, 2018

(54) D-RING KEEPER ASSEMBLY

(71) Applicant: D B Industries, LLC, Red Wing, MN (US)

(72) Inventors: Scott C. Casebolt, St. Paul Park, MN (US); Judd J. Perner, Red Wing, MN (US)

(73) Assignee: D B INDUSTRIES, LLC, Maplewood, MN (US)

( * ) Notice: Subject to any disclaimer, the term of this patent is extended or adjusted under 35 U.S.C. 154(b) by 133 days.

(21) Appl. No.: 14/815,018

(22) Filed: Jul. 31, 2015

(65) Prior Publication Data

US 2016/0361579 A1 Dec. 15, 2016

Related U.S. Application Data

(60) Provisional application No. 62/173,823, filed on Jun. 10, 2015.

(51) Int. Cl.

| | |
|---|---|
| ***A62B 35/00*** | (2006.01) |
| ***A44B 13/00*** | (2006.01) |
| ***A44B 11/12*** | (2006.01) |

(52) U.S. Cl.

CPC ..... *A62B 35/0037* (2013.01); *A44B 11/12* (2013.01); *A44B 13/0029* (2013.01); *Y10T 24/4764* (2015.01)

(58) Field of Classification Search

CPC ..... A62B 35/0037; A62B 35/0018; A62B 35/0031; A62B 35/0025; A44B 13/0029; A44B 11/005; A44B 11/006; A44B 11/2553; Y10T 24/4016; Y10T 24/4077; Y10T 24/4764

See application file for complete search history.

(56) References Cited

U.S. PATENT DOCUMENTS

| | | | |
|---|---|---|---|
| 5,228,412 | A | 7/1993 | Bell |
| 5,433,289 | A | 7/1995 | O'Rourke |
| RE35,028 | E | 8/1995 | Casebolt et al. |
| 5,531,292 | A | 7/1996 | Bell |

(Continued)

FOREIGN PATENT DOCUMENTS

| | | |
|---|---|---|
| GB | 1 227 946 | 4/1971 |

OTHER PUBLICATIONS

Cobra Sport Harness Manual, the Cobra Sport Harness. [online], [retrieved on Apr. 16, 2015] Retrieved from Google website <http://www.wetside.it/archivioWeb/Cobra_Sport_Harness_Manual_Harness_Manual_ENG1.pdf, 2 pages.

(Continued)

*Primary Examiner* — Robert Sandy
*Assistant Examiner* — Rowland Do

(57) ABSTRACT

A D-ring keeper assembly is provided. The D-ring keeper assembly includes a D-ring and a base member. The D-ring has a mid-portion, a first end portion and a second end portion. The mid-portion is curved in generally a C-shape. The D-ring further has at least one post that extends between the first and second end portions. The base member is configured and arranged to be coupled to a webbing. The at least one post of the D-ring is pivotally in communication with the base member. The base member further includes at least one locking tab that is configured and arranged to lock the position of the D-ring in relation to the base member.

24 Claims, 5 Drawing Sheets

(56) References Cited

U.S. PATENT DOCUMENTS

| | | | | |
|---|---|---|---|---|
| 6,467,573 | B1 | 10/2002 | Parker | |
| 6,527,082 | B1 | 3/2003 | Taylor | |
| 6,739,427 | B2 | 6/2004 | Gayetty | |
| 6,874,596 | B2 | 4/2005 | Zeissler et al. | |
| 6,971,476 | B2 | 12/2005 | Wolner et al. | |
| 7,073,627 | B2 | 7/2006 | Casebolt et al. | |
| 7,178,632 | B2 * | 2/2007 | Casebolt | A62B 35/0037 119/770 |
| 7,198,300 | B2 | 4/2007 | Daume et al. | |
| 7,214,015 | B2 * | 5/2007 | Bruns | B60P 7/0815 410/102 |
| 7,398,664 | B1 * | 7/2008 | Weinerman | E05B 1/0092 292/207 |
| 8,245,817 | B2 | 8/2012 | Casebolt | |
| 8,424,638 | B1 | 4/2013 | Gutherie et al. | |
| 8,727,073 | B2 | 5/2014 | Lang et al. | |
| 2003/0182764 | A1 | 10/2003 | Jeffries | |
| 2004/0265087 | A1 * | 12/2004 | Bruns | B60P 7/0807 410/107 |
| 2004/0265088 | A1 * | 12/2004 | Borrmann | B60P 7/0807 410/111 |
| 2005/0082114 | A1 | 4/2005 | Casebolt | |
| 2005/0205356 | A1 | 9/2005 | Velasco, Jr. | |
| 2007/0062760 | A1 | 3/2007 | Wolner | |
| 2007/0278036 | A1 | 12/2007 | Barta et al. | |
| 2008/0060873 | A1 * | 3/2008 | Lang | A62B 35/0018 182/3 |
| 2010/0300804 | A1 | 12/2010 | Willingham | |
| 2012/0228056 | A1 | 9/2012 | Lang et al. | |
| 2013/0104374 | A1 * | 5/2013 | Schlangen | F16B 45/02 29/525.01 |
| 2017/0291046 | A1 * | 10/2017 | Bouquier | A62B 35/0037 |

OTHER PUBLICATIONS

DBI Sala® Protecta Online Distributor, DBI Sala—ExoFit Nex™ Construction Style Harness—Back, Front & Side D Rings with Quick Connect Buckles [online], [retrieved on Apr. 16, 2015]. Retrieved from the Internet <URL:http://www.dbifallprotection.com/index.cfm/product/18/dbi-sala--exofit-nex-construction-harness--back-front--side-d-rings-with-quick-connect-buckles.cfm>, 3 pages.

Users Manual, Britannia Range of Fall Arrest Harnesses to EN361 / EN358 / EN1497, Pammenter & Petrie Limited 2004. [online], [retrieved on Apr. 16, 2015]. Retrieved from the internet <URL: http://www.safety-first.uk.com/pdf/harness-britannia.pd, 8 pages.

* cited by examiner

D-RING KEEPER ASSEMBLY

CROSS-REFERENCE TO RELATED APPLICATIONS

This Application claims priority to U.S. Provisional Application Ser. No. 62/173,823, titled "Safety Harness" herewith, filed on Jun. 10, 2015, which is incorporated in its entirety herein by reference.

BACKGROUND

Various occupations place people in precarious positions at relatively dangerous heights thereby creating a need for fall-arresting or fall protection safety apparatus. Among other things, such apparatus usually includes a safety line interconnected between a support structure and a safety harness donned by a person working in proximity to the support structure. A connector may be used to interconnect the safety line and the full-body safety harness as well as provide a connection for other attachments to the safety harness. A safety harness may also include a D-ring that can be used, for among other things, to couple a rescue system to the safety harness after a fall event. The D-ring should be accessible yet not hinder the user during normal operations.

For the reasons stated above and for other reasons stated below which will become apparent to those skilled in the art upon reading and understanding the present specification, there is a need in the art for a D-ring that can be selectively positioned along a webbing of a safety harness and not hinder normal operations of the user donning the safety harness.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a D-ring keeper assembly is provided. The D-ring keeper assembly includes a D-ring and a base member. The D-ring has a mid-portion, a first end portion and a second end portion. The mid-portion is configured and arranged to provide a connection point to the D-ring. The D-ring further has at least one post that extends between the first and second end portions. The base member is configured and arranged to be coupled to a webbing. The at least one post of the D-ring is pivotally in communication with the base member. The base member further includes at least one locking tab that is configured and arranged to lock the position of the D-ring in relation to the base member.

In another embodiment, another D-ring keeper assembly is provided. This D-ring keeper assembly includes a D-ring and a base member. The D-ring has a mid-portion, a first end portion and a second end portion. The mid-portion is curved in generally a C-shape. The D-ring further has at least one post that extends between the first and second end portions. The base member is configured and arranged to be slidably coupled to a webbing. The at least one post of the D-ring is pivotally in communication with the base member. The base member is further configured and arranged to lock the D-ring in one of an activated position and a stored position in relation to the base member.

In yet another embodiment, another D-ring keeper assembly is provided. The D-ring assembly includes a D-ring and a base member. The D-ring has a mid-portion, a first end portion and a second end portion. The mid-portion is curved in generally a C-shape. The D-ring further has at least one post that extends between the first and second end portions. The base member is configured and arranged to be slidably coupled to a webbing of a safety harness. The at least one post of the D-ring is pivotally in communication with the base member. The base member further includes at least one locking tab that is configured and arranged to lock the D-ring in one of an activated position and a stored position in relation to the base member. The activated position of the D-ring is generally perpendicular to the stored position of the D-ring in relation to the base member.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
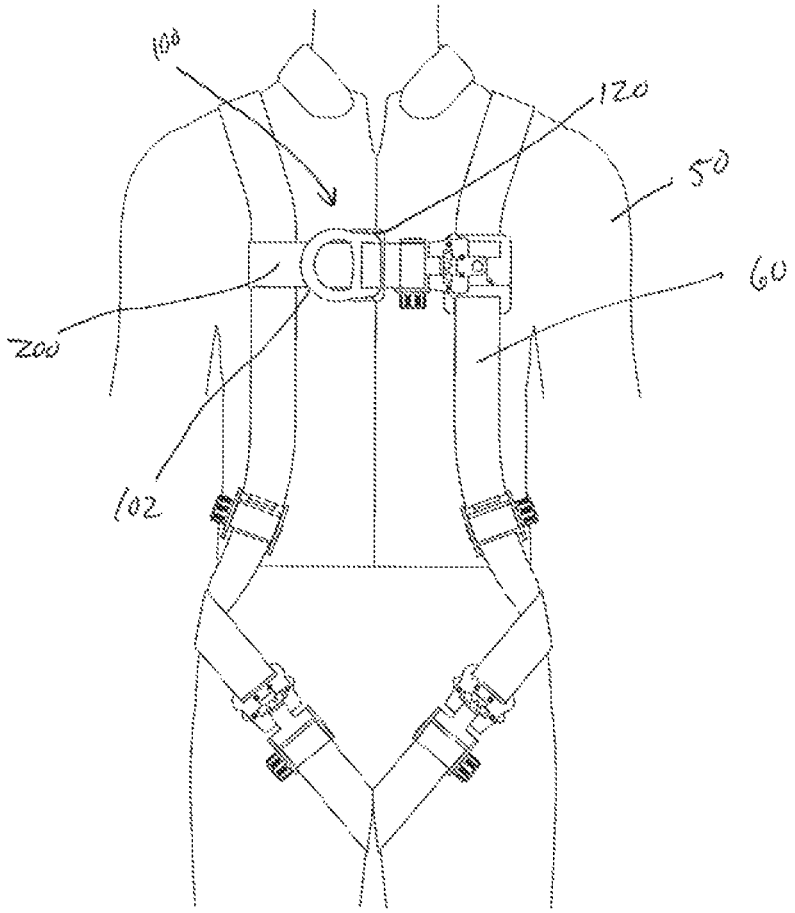
FIG. 1 is a front view of a D-ring keeper assembly coupled to a safety harness donned by a user of one embodiment of the present invention.

Embodiments of the present invention provide a D-ring keeper assembly 100 for use with a safety harness 60 donned by a user 50 as illustrated in FIG. 1. One of the features of the D-ring keeper 100 is that it can be, as illustrated in FIG. 1, coupled to chest strap 200 (or chest webbing) of the safety harness 60. Placing a D-ring 102 in front of the user 50 provides some benefits. One benefit is that if a fall event occurs, the user 50 can help guide and attach a safety lanyard (not shown) to the D-ring 102 for a rescue. Moreover, placing the D-ring on the front of the safety harness is ideal for ladder climbing situations where a lifeline and/or a lifeline that is part of a climb assist system is positioned in front of the user 50. The D-ring keeper assembly 100 is further designed, as discussed below, to be selectively positioned along the chest webbing 200. Moreover, allowing the D-ring keeper assembly 100 to move relative to the chest webbing 200 allows the D-ring 102 to be centered regardless of the length of the chest webbing 200. In addition, this feature allows the D-ring 102 to be self centered during a fall event. The D-ring keeper assembly 100 includes a D-ring 102 and a base member 120. In embodiments, the base member 120 is configured to provide an activated position and a stored position for the D-ring 102.

Figure 2A:
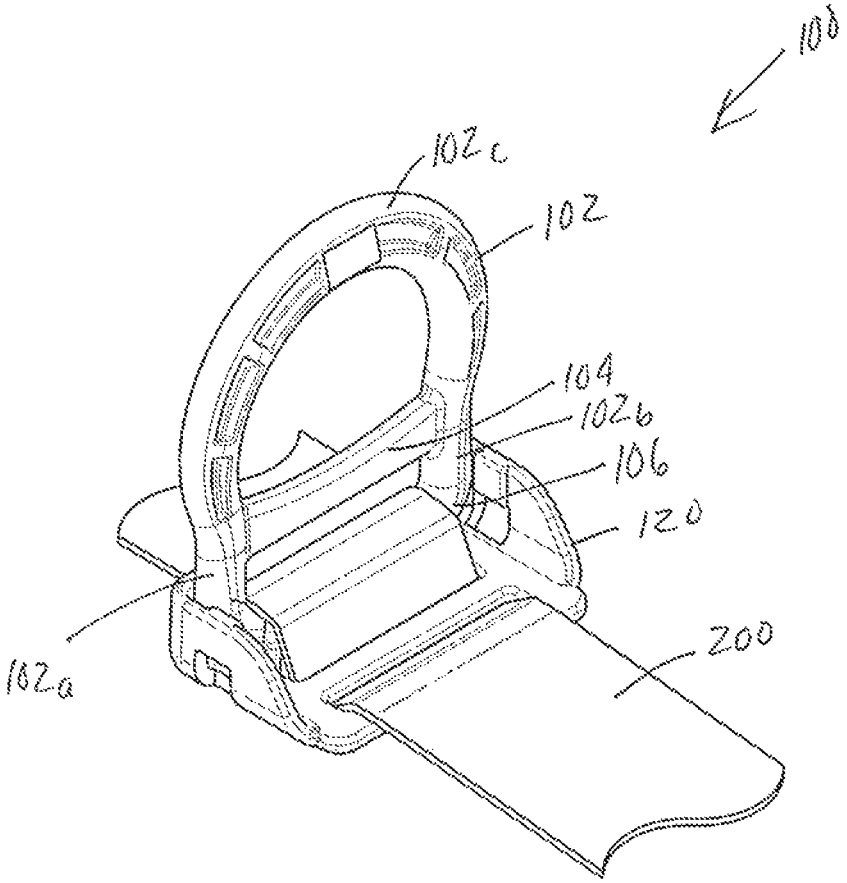
FIG. 2A is a side perspective view of the D-ring keeper of FIG. 1 with its D-ring in an activated position.
Figure 2B:
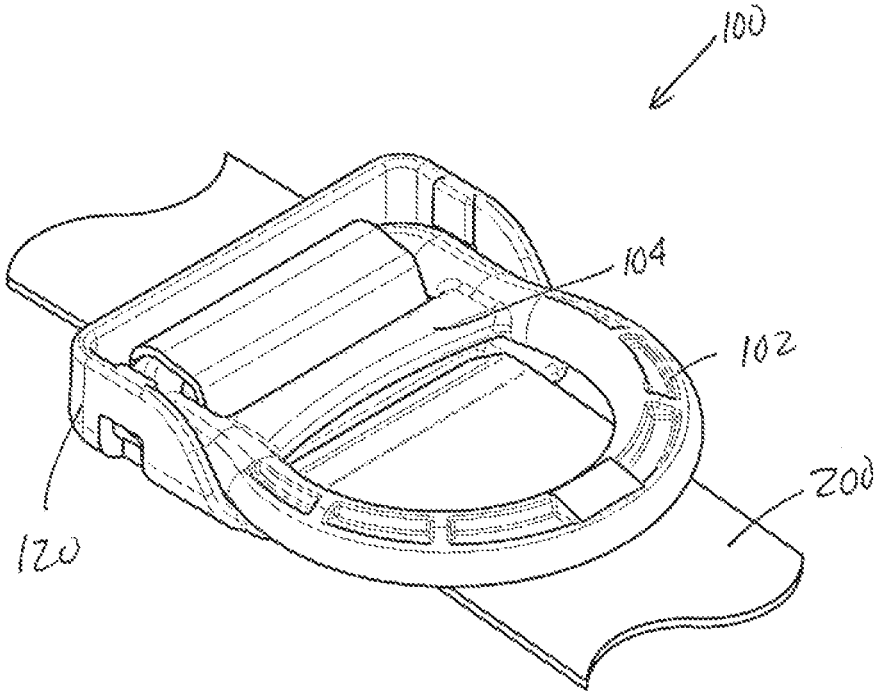
FIG. 2B illustrates the D-ring keeper of FIG. 1 with its D-ring in a stored configuration.

An illustration of the D-ring 102 in an activated position is illustrated in FIG. 2A. The D-ring 102 includes a mid-portion 102*c*, a first end portion 102*a* and a second end portion 102*b*. The mid-portion 102*c* of the D-ring 102 is curved in generally a C-shape. The D-ring 102 further has a first post 104 and a second post 106. The first and second posts 104 and 106 extend between the first and second end portions 102*a* and 102*b* in a spaced configuration. The mid-portion 102*c* is designed to be attached to a lifeline or lanyard via connector (not shown) if a fall event occurs and a rescue is required. The D-ring 102 in the stored position in relation to the base member 120 is illustrated in FIG. 2B. The D-ring 102 would be in the closed position during normal use of the safety harness 60. As discussed below, the base member 120 selectively holds the D-ring 102 in either the stored position or the activated position as discussed further in detail below.

Figure 3A:
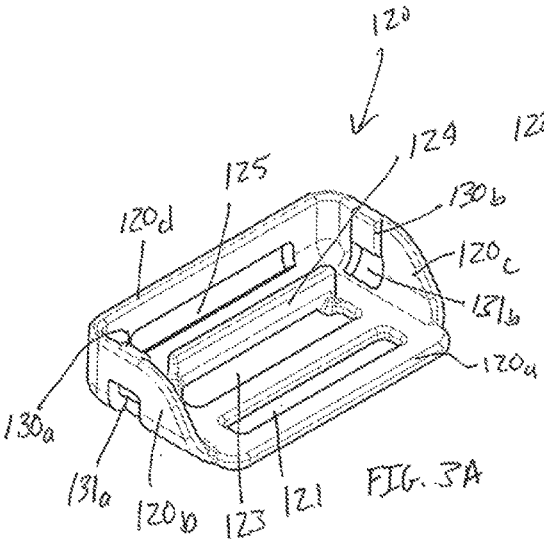
FIG. 3A illustrates a side perspective view of a base member of the D-ring keeper assembly of FIG. 1 in one embodiment of the present invention.
Figure 3B:
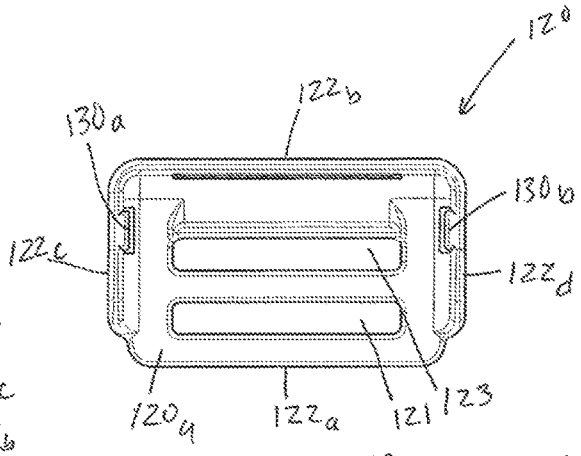
FIG. 3B is a front view of the base member of FIG. 3A.
Figure 3C:
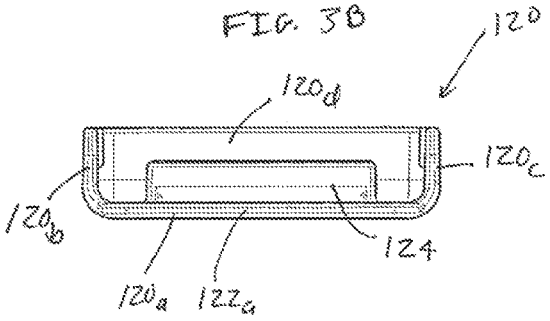
FIG. 3C is an end view of the base member of FIG. 3A.

The base member is illustrated in FIGS. 3A through 3C. The base member 120 includes a base plate 120*a*. The base plate 120*a* has a front edge 122*a* and opposed back edge 122*b*, a first side edge 122*c* and an opposed second side edge 122*d* as best illustrated in FIG. 3B. The base member 120 further has a first side wall 120*b* that extends from the first side edge 122*c* of the base plate 120*a* and a second side wall 120*c* that extends from the second side edge 122*d* of the base plate 120*a* as best illustrated in FIG. 3A. Along the back edge 122*b* extends a back wall 120*d*. The back wall 120*b* further extends between the first side wall 120*b* and the second side wall 120*c*. The base plate 120*a* further includes parallel spaced first and second slots that generally extend a select distance between the first side edge 122*c* and the second side edge 122*d*. The back wall 120*d* further includes a third slot 125 that is also positioned in a parallel fashion with the first and seconds slots 121 and 123. Extending from a surface of the base plate 120*a* between the second and third slots 123 and 125 is a holding plate member 124. The holding plate member 124 is also positioned generally parallel with the first, second and third slots 121, 123 and 125. The first side wall 120*b* and the second sidewall 120*c* further include aligned locking tabs 130*a* and 130*b* that extend out of an inner surface of the respective first and second sidewalls 120*b* and 120*c* towards each other. Positioned between the locking tabs 130*a* and 130*b* and the base plate 120*a* are respective passages 131*a* and 131*b*.

Figure 4A:
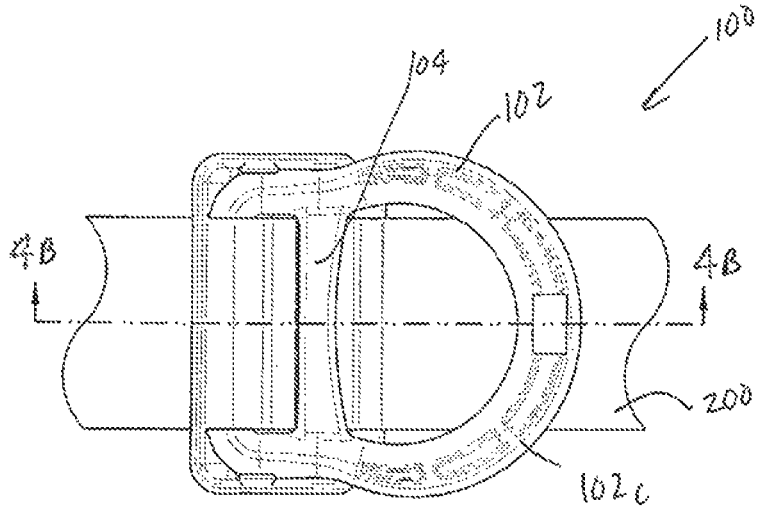
FIG. 4A is a front view of the D-ring keeper assembly of FIG. 1.
Figure 4B:
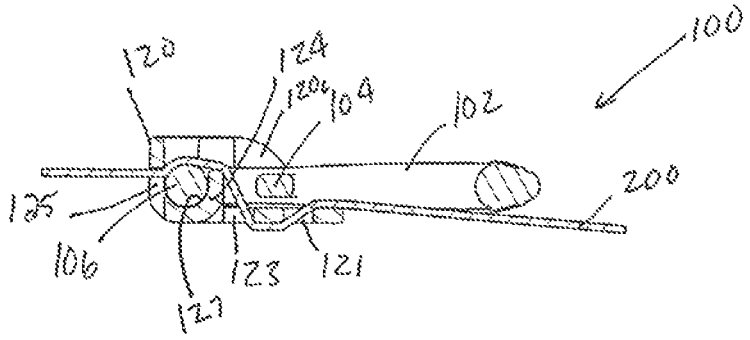
FIG. 4B is a cross-sectional side view of the D-ring keeper along line 4B-4B.

The holding plate member 124 and the base plate 120*a* form a curved surface 127 that generally matches the radius of curvature of the second post 106 of the D-ring 102 between the holding plate member 124 and the back wall 120*d*. This is best illustrated in the cross-sectional side view in FIG. 4B. The cross-sectional side view in FIG. 4B is along the line 4B-4B on D-ring keeper assembly 100 in FIG. 4A. The second post 106 of the D-ring is positioned to engage the curved surface 127. Webbing 200 is routed through the third slot 125, over the second post 106 of the D-ring 102, through the second slot 123 and then through the first slot 121. This arrangement couples the D-ring 102 to the keeper base member 120. The D-ring 102 pivots about the curved surface 127. The aligned locking tabs 130*a* and 130*b* on the respective first and second side walls 120*b* and 120*c* are positioned to selectively lock the D-ring 102 in either an activated position in relation to the base member 120 or a stored position in relation to the base member 120. That is, the locking tabs 130*a* and 130*b* selectively prevent movement of the D-ring 102 in relation to the base plate 120*a* without a select force that causes the D-ring to pass over the locking tabs 130*a* and 130*b*. Hence, the base member 120 is made of semi-pliable material that allows the tabs 130*a* and 130*b* to be moved out away from each other under a select force and then return to their original position after the force is removed. The select force is applied to the locking tabs by rotation of the D-ring 102. In use, the user locks the D-ring 102 in the stored position by forcibly rotating the D-ring until the first and second end portions 102*a* and 102*b* are positioned past the locking tabs 130*a* and 130*b*. The locking tabs 130*a* and 103*b* are then positioned to prevent the D-ring 102 from moving. In the stored position, the D-ring 102 is in a position that does not interfere with normal operations of the user (i.e. it is unlikely to get hung up on objects). In the stored position, the D-ring 102 is positioned generally parallel with the base plate 120*a* of the base member 120. If a fall event occurs, and a rescue attempt is to be attempted via the D-ring keeper assembly 100, the D-ring 102 is rotated in relation to the base member 102 with enough force to once again move the locking tabs 130*a* and 130*b* of the base member 120 away from each other. Once the first and second end portions 102*a* and 102*b* of the D-ring 102 rotate past the locking tabs 130*a* and 130*b*, the locking tabs 130*a* and 130*b* return back into their normal spaced location in relation to each other locking the D-ring 102 in the activated position. In the activated position, the D-ring 102 is generally positioned perpendicular to the base plate 120*a* of the base member 120. This position allows easy access to couple a connector such as, but not limited to, a carabiner that is coupled to a lifeline or lanyard.

As briefly discussed above, another feature of the D-ring keeper assembly 100 is that it can be positioned at any location along the chest webbing 200. Hence, the D-ring keeper assembly 100 can be positioned for convenience or for optimal position during a rescue. This feature is illustrated in the cross-sectional view in FIG. 4B. As illustrated, the webbing 200 is routed through the third slot 125, over the second post 106 of the D-ring 102, through the second slot 123 and then through the first slot 121 of the base member 120. This arrangement allows the base member 120 to move along the length of the webbing 200 via pulling or pushing on the D-ring keeper assembly 100. Friction between the webbing 200 and the base member 120 holds the D-ring keeper assembly 100 in a static relationship to the webbing 200 until sufficient force is applied to the D-ring keeper assembly 100. Although, the D-ring keeper assembly 100 is illustrated as being attached to a chest webbing 200, the D-ring keeper assembly 100 can be attached to any webbing and is not limited to a chest webbing 200 of a safety harness 60.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A D-ring keeper assembly comprising:

a D-ring having a mid-portion, a first end portion and a second end portion, the mid-portion being configured and arranged to provide a connection point to the D-ring, the D-ring further having at least one post that extends between the first and second end portions; and a base member configured and arranged to be coupled to a webbing, the at least one post of the D-ring pivotally in communication with the base member, the base member including a base plate having a first side wall extending upward from a first side edge, a second side wall extending upward from a second side edge, and a back wall extending upward from a back edge, the base member further including at least one locking tab configured and arranged to lock the D-ring in relation to the base member, the at least one locking tab configured and arranged to selectively lock the D-ring in at least one of an activated position and a stored position, the mid-portion of the D-ring extending outward from proximate the back edge of the base member in a first direction parallel to the back wall in the activated position, and the mid-portion of the D-ring extending outward from proximate a front edge of the base member in a second direction parallel to the base member in the stored position, the first direction being different than the second direction.

2. The D-ring keeper assembly of claim 1, wherein the base member is slidably coupled to the webbing.

3. The D-ring keeper assembly of claim 1, wherein the at least one post includes a first post and a second post in a spaced configuration, the second post pivotally in communication with the base member, the webbing passing between the first post and the second post.

4. The D-ring keeper assembly of claim 1, wherein the base plate further comprises:

at least a pair of spaced slots configured and arranged to couple the base plate to the webbing.

5. The D-ring keeper assembly of claim 4, wherein the at least one locking tab includes a first locking tab and a second locking tab.

6. The D-ring keeper assembly of claim 5, further comprising:

the first locking tab extending out from a surface of the first side wall over the base plate; and the second locking tab extending out from a surface of the second side wall over the base plate, the first locking tab being aligned with the second locking tab.

7. The D-ring keeper assembly of claim 6, further comprising:

the first locking tab engaging the first end portion of the D-ring; and the second locking tab engaging the second end portion of the D-ring.

8. The D-ring keeper assembly of claim 7, wherein the base member is semi-pliable to allow the first and second locking tabs to move away from each other under a select force applied by pivoting the D-ring.

9. The D-ring keeper assembly of claim 1, further comprising:

a holding plate member extending from a surface of the base plate, the holding plate extending out from the surface in generally a parallel fashion with the back wall and being positioned between the first side wall and the second side wall, the holding plate, a portion of the base plate and the back wall forming a curved surface that is configured to engage the at least one post of the D-ring.

10. The D-ring keeper assembly of claim 9, wherein the back wall having a back slot further configured to receive the webbing, the webbing holding the at least one post of the D-ring in the formed curved surface of the base plate.

11. The D-ring keeper assembly of claim 1, wherein the first side wall, the second side wall, and the back wall form a generally U-shaped wall member extending upward from the base plate.

12. The D-ring keep assembly of claim 1, wherein the at least one locking tab extends inward from at least one of the first side wall and the second side wall.

13. A D-ring keeper assembly comprising:

a D-ring having a mid-portion, a first end portion and a second end portion, the mid-portion being curved in generally a C-shape, the D-ring further having at least one post that extends between the first and second end portions; and a base member configured and arranged to be slidably coupled to a webbing, the at least one post of the D-ring pivotally in communication with the base member, the base member including a base plate having a first side wall extending upward from a first side edge, a second side wall extending upward from a second side edge, and a back wall extending upward from a back edge, the base member configured and arranged to lock the D-ring in one of an activated position and a stored position in relation to the base member, the mid-portion of the D-ring extending outward from proximate the back edge of the base member in a first direction parallel to the back wall in the activated position, and the mid-portion of the D-ring extending outward from proximate a front edge of the base member in a second direction parallel to the base member in the stored position, the first direction being different than the second direction.

14. The D-ring keeper assembly of claim 13, further comprising:

the base member including at least one locking tab configured and arranged to lock the position of the D-ring in each of the activated position and the stored position in relation to the base member.

15. The D-ring keeper assembly of claim 13, wherein the base further comprises a first slot and a spaced second slot and the back plate further comprises a back slot, the first slot, the second slot, and the back slot configured and arranged to slidably couple the base plate to the webbing.

16. The D-ring keeper assembly of claim 15, further comprising:

a holding plate member extending from a surface of the base plate, the holding plate extending out from the surface in generally a parallel fashion in relation to the back wall and being positioned between the first side wall and the second side wall, the holding plate, a portion of the base plate and the back wall forming a curved surface that is configured to engage the at least one post of the D-ring, the webbing holding the at least one post of the D-ring in the formed curved surface of the base plate.

17. The D-ring keeper assembly of claim 16, wherein the at least one locking tab further comprises:

a first locking tab extending out from a surface of the first side wall toward the base plate, the first locking tab engaging the first end portion of the D-ring; and a second locking tab extending out from a surface of the second side wall toward the base plate, the second locking tab engaging the second end position of the D-ring, the first locking tab being aligned with the second locking tab.

18. The D-ring keeper assembly of claim 13, wherein the first side wall, the second side wall, and the back wall form a generally U-shaped wall member extending upward from the base plate.

19. The D-ring keeper assembly of claim 13, wherein the at least one locking tab extends inward from at least one of the first side wall and the second side wall.

20. A D-ring keeper assembly comprising:

a D-ring having a mid-portion, a first end portion and a second end portion, the mid-portion being curved in generally a C-shape, the D-ring further having at least one post that extends between the first and second end portions; and a base member configured and arranged to be slidably coupled to a webbing of a safety harness, the at least one post of the D-ring pivotally in communication with the base member, the base member including a base plate having a first side wall extending upward from a first side edge, a second side wall extending upward from a second side edge, and a back wall extending upward from a back edge, the base member further including at least one locking tab configured and arranged to lock the D-ring in one of an activated position and a stored position in relation to the base member, the mid-portion of the D-ring extending outward from proximate the back edge of the base member in a first direction parallel to the back wall in the activated position, and the mid-portion of the D-ring extending outward from proximate a front edge of the base member in a second direction parallel to the base member in the stored position, the first direction of the activated position generally perpendicular to the second direction of the stored position in relation to the base member.

21. The D-ring keeper assembly of claim 20, wherein the base plate further comprises:

a first slot and a spaced second slot;

The back wall further having a back slot, the first slot, the second slot and the back slot configured and arranged to slidably couple the base plate to the webbing; and a holding plate member extending from a surface of the base plate, the holding plate extending out from the surface in generally a parallel fashion with the back wall and being positioned between the first side wall and the second side wall, the holding plate, a portion of the base plate and the back wall forming a curved surface that is configured to engage the at least one post of the D-ring, the webbing holding the at least one post of the D-ring in the formed curved surface of the base plate.

22. The D-ring keeper assembly of claim 20, wherein the at least one locking tab further comprises:

a first locking tab extending out from a surface of the first side wall toward the base plate, the first locking tab engaging the first end portion of the D-ring; and a second locking tab extending out from a surface of the second side wall toward the base plate, the second locking tab engaging the second end position of the D-ring, the first locking tab being aligned with the second locking tab.

23. The D-ring keeper assembly of claim 20, wherein the first side wall, the second side wall, and the back wall form a generally U-shaped wall member extending upward from the base plate.

24. The D-ring keeper assembly of claim 20, wherein the at least one locking tab extends inward from at least one of the first side wall and the second side wall.

* * * * *